US010689075B2

(12) United States Patent
Camblong et al.

(10) Patent No.: US 10,689,075 B2
(45) Date of Patent: Jun. 23, 2020

(54) COMMAND AND CONTROL DEVICE FOR KITES

(71) Applicant: MX PRODUCTION, Bidart (FR)

(72) Inventors: Martial Camblong, Bidart (FR); Siegfried Vlaminck, Esquièze-Sère (FR)

(73) Assignee: MX PRODUCTION, Bidart (FR)

( * ) Notice: Subject to any disclaimer, the term of this patent is extended or adjusted under 35 U.S.C. 154(b) by 396 days.

(21) Appl. No.: 15/644,679

(22) Filed: Jul. 7, 2017

(65) Prior Publication Data

US 2018/0022430 A1 Jan. 25, 2018

(30) Foreign Application Priority Data

Jul. 19, 2016 (FR) ..... 16 56874

(51) Int. Cl.

| | |
|---|---|
| ***B63H 8/16*** | (2020.01) |
| ***B63H 9/00*** | (2006.01) |
| ***B64C 31/06*** | (2020.01) |
| *B63H 9/10* | (2006.01) |

(52) U.S. Cl.

CPC ..... *B63H 8/16* (2020.02); *B63H 9/00* (2013.01); *B64C 31/06* (2013.01); *B63H 9/10* (2013.01)

(58) Field of Classification Search

CPC ..... B64C 31/06; B63H 9/10; B63H 9/0685; B63H 2009/0692; B63H 9/08; B63H 9/00; B63H 9/0607; B63H 2009/088; B63H 9/1007; B63B 35/7979; B63B 15/0083; B63B 35/7976; B63B 35/7993

See application file for complete search history.

(56) References Cited

U.S. PATENT DOCUMENTS 3,626,883 A * 12/1971 Ellis ..... B63H 9/10 114/39.29
3,858,542 A * 1/1975 Lenoble ..... B63B 35/7973 114/102.11
4,280,431 A * 7/1981 Sofen ..... B63H 9/1092 114/105
4,969,411 A * 11/1990 Smernoff ..... B63H 9/10 114/102.19
5,134,952 A * 8/1992 Doolittle ..... B63B 35/7973 114/39.12

(Continued)

FOREIGN PATENT DOCUMENTS

DE 203 15 464 U1 12/2003
FR 3 013 227 A1 5/2015

(Continued)

*Primary Examiner* — Assres H Woldemaryam
(74) *Attorney, Agent, or Firm* — IM IP Law; Chai Im; C. Andrew Im

(57) ABSTRACT

A command and control bar for a kite sail associated with two front cables connected to a user and two rear cables connected to the bar. The cables are connected at one end to the sail. An adjustment element to shorten/extend the rear cables is incorporated into the bar and can be controlled by the user without releasing the bar. A deflection system can be displaced parallel to the axis of the bar and is connected to a return element. The bar includes a locking element to lock/release the position of the deflection system along the bar, depending on the traction forces applied on the cables. The locking element is accessible to the user from outside the bar.

16 Claims, 5 Drawing Sheets

(56) References Cited

U.S. PATENT DOCUMENTS

| | | | | | |
|---|---|---|---|---|---|
| 5,485,799 | A * | 1/1996 | Julien | B63H 9/06 | 114/102.16 |
| 5,524,565 | A * | 6/1996 | Lavin | B63H 9/04 | 114/219 |
| 5,603,276 | A * | 2/1997 | Julien | B63H 9/06 | 114/39.21 |
| 5,988,086 | A * | 11/1999 | Mitchell | B63H 9/08 | 114/102.15 |
| 5,996,519 | A * | 12/1999 | Mitchell | B63H 9/06 | 114/102.15 |
| 2005/0121556 | A1* | 6/2005 | Blackman | B63B 35/7979 | 244/155 A |
| 2008/0190341 | A1* | 8/2008 | Baruh | B63B 15/00 | 114/39.32 |
| 2011/0168071 | A1* | 7/2011 | Baruh | B63B 15/02 | 114/39.26 |
| 2011/0303140 | A1* | 12/2011 | Cordier | B63H 9/10 | 114/102.12 |
| 2012/0018584 | A1* | 1/2012 | Lawson | B63B 35/7979 | 244/155 A |
| 2017/0073053 | A1* | 3/2017 | Clement | B63H 9/1042 | |

FOREIGN PATENT DOCUMENTS

| | | | | |
|---|---|---|---|---|
| WO | 88/09285 | A1 | 12/1988 | |
| WO | WO-8809285 | A1 * | 12/1988 | B63B 35/7973 |
| WO | 2011/014904 | A1 | 2/2011 | |

* cited by examiner

COMMAND AND CONTROL DEVICE FOR KITES

RELATED APPLICATIONS

This application claims priority from French Patent Application No. 16 56874 filed Jul. 19, 2016, which is incorporated herein by reference in its entirety.

FIELD OF THE INVENTION

This invention relates to an improved command and control device for a traction sail of the kite type, or for the rigging of a sailboat (integrated into the boom).

The invention further relates to a kite sail or a sailboat boom for a sailboard, fitted with such a device.

The invention will be described in view of its application to a kite sail, integrated into the bar of said sail, without being limited to that application.

BACKGROUND OF THE INVENTION

It is known that kite sails are made up of one or more soft sails, generally elliptical or semi-elliptical in shape, flat or semi-flat, where the concave side is designed to be placed in the wind to create a means of traction, and possibly movement, by a user or other, connected to the sail by cables called lines.

Such sails have many possible applications, particularly in sports involving sliding on land, water or snow, and used, for instance for kitesurfing, mountain boarding, snowkiting, kite buggying, all of which are powered by a traction kite. These sails are used to power all kinds of nautical or land equipment, sliding or rolling, but are also used in electricity generation systems that use the force generated by such sails.

Such a sail generally comprises a leading edge (front) and a trailing edge (rear).

The sail further comprises:

- two lines that manage steering and power, known as rear lines, connected to the left and right-hand side rear ends of the sail;
- two lines known as front lines, connected to the leading edge of the sail;
- a fifth line known as the safety line, connected to the user by a dropping system and fixed directly or indirectly via optional bridling to the leading edge of the sail or one of the four front and rear lines.

The ends of the four rear and front lines opposite the sail are connected to the user through a control bar; more precisely, the ends of the two front lines are connected to a central end going through the bar, while the ends of the rear lines are fixed to the left and right ends of the bar.

The central part of the bar is connected to the user by a dropping system connected to a harness worn by the user or the like. The bar is held by the user in their two hands.

Depending on the wind force, the user adjusts the traction power of the sail by varying its inclination along a variable plane demarcated by the fastening points of the front and rear lines, by shortening or lengthening the distance between the fastening point and the harness.

Depending on the wind force, the user can vary the traction power of the sail by varying its inclination using the sliding bar connected to the rear lines (steering and power) in relation to the front lines (traction).

If the wind force is too high or not high enough for the user, the user can also adjust the power of the sail and thus extend its range of use thanks to a central adjustment and deflection system that most generally connects the two front lines. That operation modifies the adjustment of the incidence of the sail.

In a known manner, this maneuver is carried out via a central adjustment and deflection system that most generally connects the two front lines centrally, and slides perpendicularly through or close to the bar. Said system makes it possible to adjust the incident inclination of the sail, by reducing or extending the distance between the rear trailing edge and the fastening point to the front harness. The same system or its equivalent may also be made from the rear lines.

Thus, by pushing or pulling the bar, the incidence of the sail can be decreased or increased, which decreases or increases the tension in the (front and rear) lines by aerodynamic effect.

To control the central deflection system, the user must release one hand, and the bar is then held in only one hand.

That creates a major drawback in terms of controlling the sail, which is all the more disadvantageous because the user precisely needs to better control the bar when the wind force and/or direction changes.

In the French patent application 1361291 filed by the applicant, a bar was proposed with a central winder on the bar that can be controlled by a single hand and associated with a deflection mechanism (internal to the bar) connected to the two ends of the rear cables.

Even though this system makes an advantageous improvement to prior bars, it can be improved in view of speed and responsiveness, the effort to be made by the user and the traction power on the cables.

Further, known mechanisms are not totally sealed, and the presence of sand affects their working and reliability.

OBJECT AND SUMMARY OF THE INVENTION

This invention relates to a command and control bar for traction sails, which enables the user to adjust the power of the sail, that is to say the inclination (known as the incidence) of the sail while holding the bar with both hands, using the least effort, speedily and responsively, with incomparable precision, and lastly in a manner that is virtually sealed from sand.

To that end, according to the invention, the command and control bar for a sail of the kite type known as a traction sail, liable to be associated with two front cables and two rear cables, wherein the cables are intended to be connected at one end to said sail, the bar has a substantially cylindrical elongated shape, the rear cables are connected to the bar and the front cables are intended to be connected to the user, means are provided to shorten or extend the front or rear cables in order to vary the inclination of the sail, wherein the means to shorten/extend the rear cables are incorporated into the bar so as to allow control by one of the hands of the user without releasing the bar, wherein each rear cable is associated with a deflection system that creates, for each rear cable, a cable strand of variable length, characterized in that said deflection system can be displaced parallel to the axis of the bar, and is connected to return means, and the bar comprises means adapted to lock/release the position of the deflection system along the bar, depending on the traction forces applied on the cables, wherein said locking/releasing means are accessible to at least one finger of the user from outside the bar.

Thus, the user shortens/extends the cable firstly without releasing the bar, and secondly using little force, thanks to the return means.

Advantageously, the bar comprises a long element, such as a strip, one end of which is integral with the mobile deflection system and the other end of which is connected to the return means.

Preferably, said long element, the deflection means, the cable strands of variable length and the return means are arranged inside the bar.

The deflection system comprises a mobile slide.

Particularly, the long element is a small bar or a rigid rod.

The bar comprises means adapted to lock and release the displacement of the long element, and these means comprise a mobile male lug, adapted to be in two stable positions, namely a locking position, where it cooperates with openings or notches made on the long element, and a retracted releasing position, which allows the displacement of the long element and thus the deflection system.

More specifically, the lug is connected by a transmission mechanism to a pushbutton that can be controlled by a finger of the user from the outside of the bar. Thus, the bar comprises a control mechanism, particularly including a pushbutton accessible from the outside of the bar, and a transmission mechanism inside the bar connecting said pushbutton to the lug.

Said return means comprise a gas lift cylinder or a return spring.

Said long element is connected firstly to the return means and secondly to the deflection system by an additional respective pulley.

A device for a traction sail of the kite type or a sail of a sailboat, paraglider or sailboard, connected to said sail by at least one cable or line, a device intended to command and/or control said sail, wherein the device has a substantially cylindrical elongated shape, wherein means are provided to shorten or extend the at least one cable in order to stretch the sail or alter the inclination/incidence of the sail, wherein the means for shortening/extending the rear cable are incorporated into the device so as to allow control with one of the hands of the user without having to release the device, wherein each cable (5, 6) is associated with a deflection system that creates, for each cable, a cable strand with a variable length, characterized in that said deflection system can be displaced parallel to the axis of the device, and is connected to return means, and in that the device comprises means adapted to lock/release the position of the deflection means along the bar, depending on the traction forces applied on the cable, wherein said locking/release means are accessible to at least one finger of the user from outside the device.

The invention further relates to an assembly for a traction sail of the kite type, or the sail of a sailboat, paraglider or sailboard, comprising a sail and at least one cable or line connecting the sail to said command bar as described and claimed, or connecting the sail to said device as described and claimed.

The invention may be associated with sails in a number of applications, particularly sports involving sliding on land, water or snow, which are used for kitesurfing, mountain boarding, snow kiting, or kite buggying. These sails are used to power all kinds of nautical or land equipment, sliding or rolling, but are also used in electricity generation systems that use the force generated by such sails.

The terms "front", "rear", "distal", "longitudinal", "diagonal" refer to elements as part of the normal use of the bar according to the invention, by reference to a user standing up and holding the bar.

BRIEF DESCRIPTION OF THE DRAWINGS

The invention will be better understood in the light of the description below of illustrative but non-limitative examples by reference to the attached drawings wherein.

DETAILED DESCRIPTION OF THE EMBODIMENTS

Figure 1:
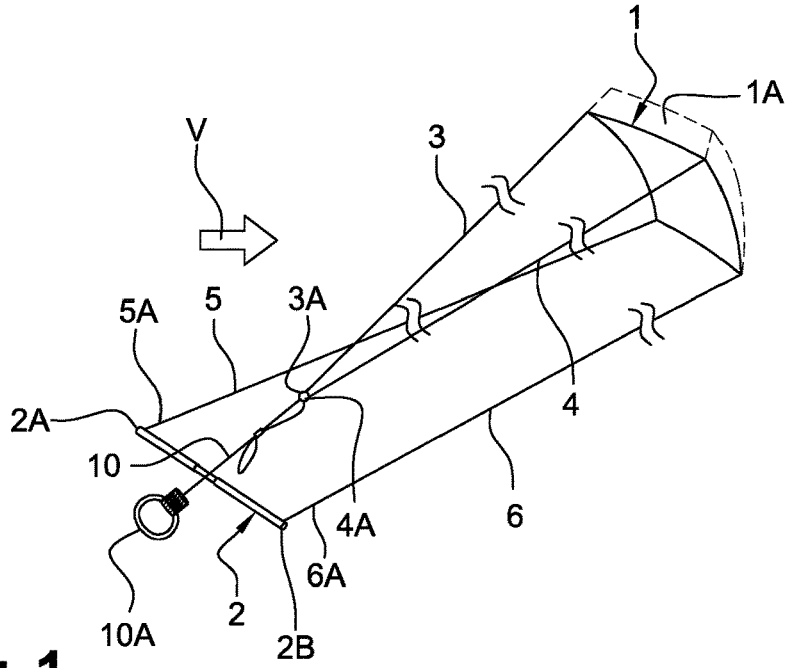
FIG. 1 is a simplified perspective view of a sail associated with four lines or cables connected a command bar.

FIG. 1 is a schematic diagram of a convex sail 1 that is shaped like a parallelepiped or square, and is connected to a command bar 2, held by a user, who is not shown, through two front cables or lines 3 and 4 and two rear lines or cables 5 and 6.

The lines or cables 3, 4, 5, and 6 have one end each connected to a respective corner of the sail 1. The ends 6A and 5A, opposite the sail 1, of the rear cables 5 and 6 are connected to the ends 2A, 2B of the bar 2. The ends 3A and 4A (opposite sail 1) of the front cables 3 and 4 are connected to a common central end 10 that passes close to or at the center of the command bar 2. Beyond bar 2, opposite the sail, the end 10 protruding from the bar is connected to a handle or ring, known as the "dropping" ring 10 A.

In a known manner, depending on the wind speed and/or direction symbolized by the arrow V, the user holding the bar 2 modifies the length of the front cables 3 and 4, by example in the manner shown in FIG. 1 where the sail then is in the position represented in dotted lines and referenced 1A.

Thus, the user can modify the leading angle of the sail in relation to the force of the wind, and thus adjust and control the sail traction power.

The user can therefore move on the water, on a sailboard or the like, or on the land, on a buggy or the like.

Figure 2:
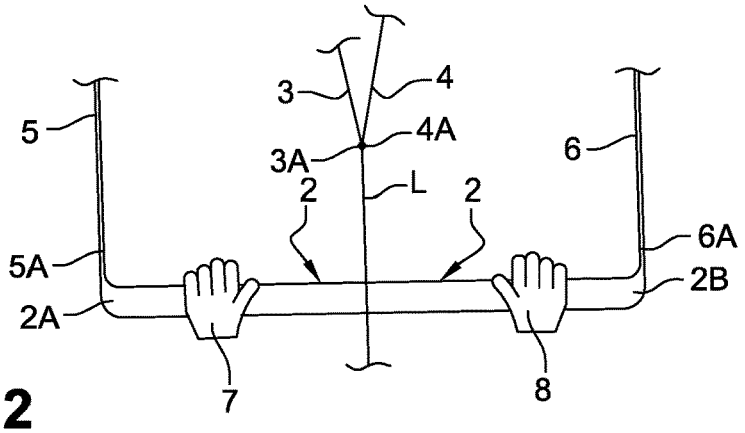
FIG. 2 is a top schematic view showing the bar and the four associated lines.

FIG. 2 is a schematic view of the bar 2 of FIG. 1. The bar is connected to the sail 1 through the front cables 3 and 4, the ends 3A and 4A of which are connected to the common end L that goes through the command bar, and the rear cables 5 and 6, the respective distal ends 5A and 6A of which are fixed to ends 2A and 2B of the command bar 2.

At the "cruising speed" of use, the user holds the bar 2 with their left 7 and right 8 hands, while a harness (known in itself and not shown) connects the bar 2 to the user, who is not shown.

The bar according to the invention has a system for adjusting the length of the rear cables 5 and 6, which adjusts the power of the sail by shortening/extending said cables, where said system can be controlled by one of the hands of the user without releasing the bar. The front cables or lines are thus, in the described exemplary embodiment, fixed in length.

Figure 3:
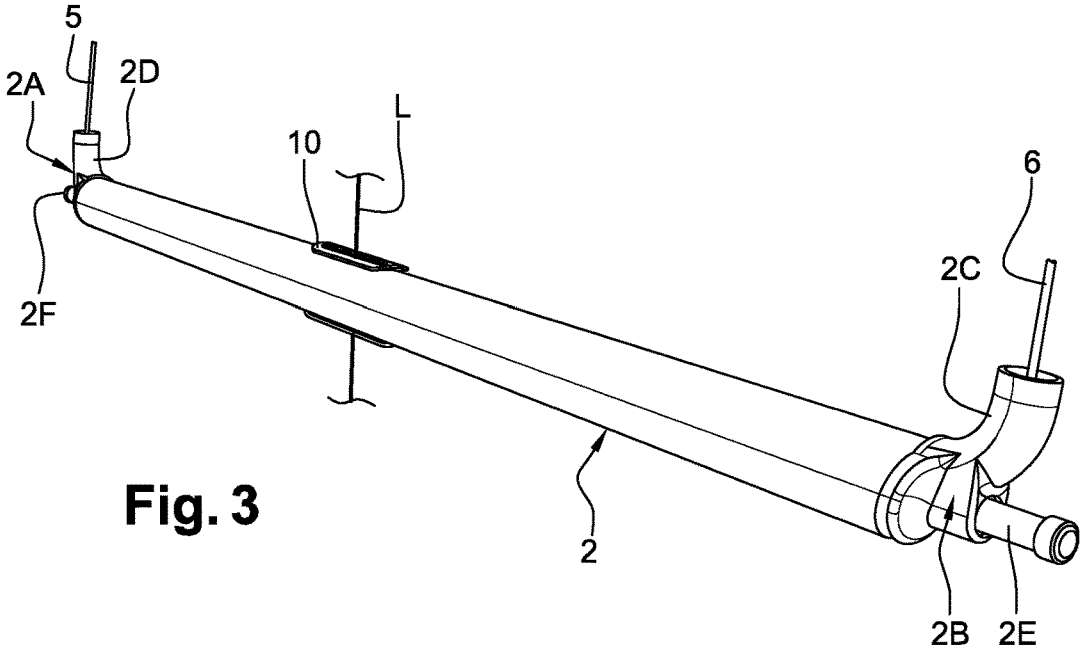
FIG. 3 is a perspective view of the bar according to the invention.

FIG. 3 is a perspective view of the bar according to the invention with the elements described above, and the following additional elements:

- two bent end sleeves 2C and 2 D for routing the cables 5 and 6 respectively;
- two longitudinal threaded rods 2E and 2F penetrating in the bar 2 at the respective ends of the bar and designed for tightening/locking the ends of the bar;
- a radial sleeve 10 that creates a through passage for the common end L.

The system according to the invention, for shortening/extending the cables 5 and 6, is placed inside the bar and has been described below by reference to FIG. 4, in a first stage, showing one embodiment.

Figure 4:
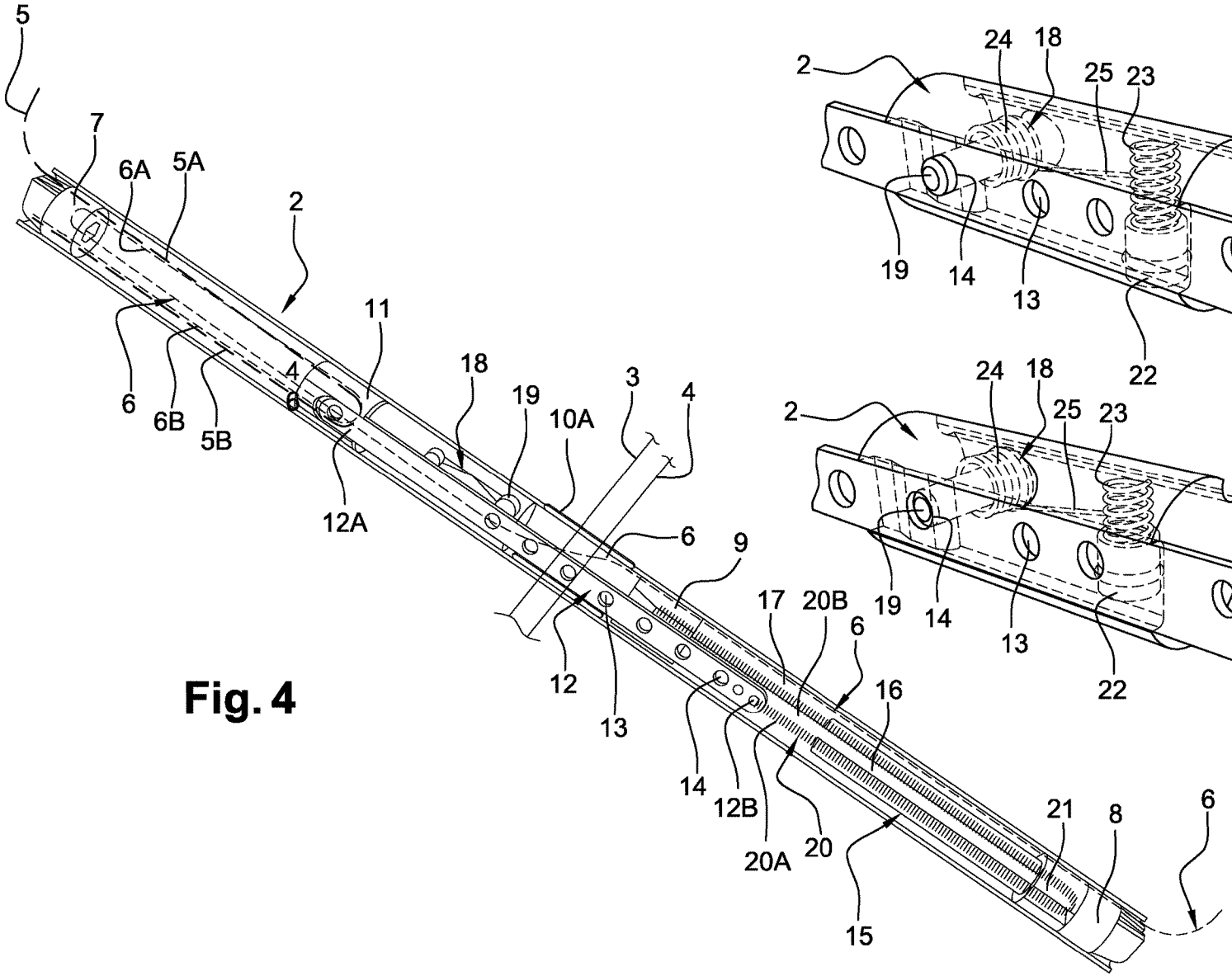
FIG. 4 is a perspective cutaway view of a form of embodiment of the command bar according to the invention, with the cylinder and strip.

FIG. 4 shows the rear cables 5 and 6 and the front cables 3 and 4. The bar 2 according to the invention is made of a hollow cylinder in metal or composite material, and for example carbon, which is approximately 30 to 60 cm long with a diameter of approximately 20 to 30 mm. The bar is shown in FIG. 3, in a longitudinal section and cut away so as to show the inside.

At its two ends, the bar has two closing sleeves 7 and 8 and a fixed sleeve 9 substantially at the center.

The front cables 3 and 4 go through the bar 2, substantially at its center, through an opening 10A created in the bar 2, designed to receive the sleeve 10 (not shown) in FIG. 3, to route said cables beyond the bar, towards the harness (not shown) worn by the user. More precisely, the front cables 3 and 4 go through the bar in a duct (not shown to allow clarity) that guides them. The duct is placed diagonally on the bar at a notch demarcating the central opening 10.

In the bar, the following are also provided:

- A slide 11 with a complementary shape adapted to move longitudinally in the bar;
- A longitudinal strip 12, made integral with said slide 11 and which is approximately 17 cm long, comprising a plurality of cylindrical and regularly spaced holes 13, 14 etc. on part of the length of the strip;
- A gas lift cylinder 15 comprising a cylinder body 16 inside which a piston 17 moves, the distal end of which is fixed to the central fixed sleeve 9;
- A fixed functional block 18, placed close to the opening 10 for routing the front cables and comprising a control mechanism 18 (detailed later on) for a lug 19 that can move diagonally, the end of which is adapted to go through one of the holes provided in the strip 12.

The left-hand rear cable 5 goes through the extreme left sleeve 7 and onto a guide pulley, not shown, inside the bar 2, arranged inside the slide 11. The end of the left rear cable 5 is connected to the left end sleeve 7.

Thus, inside the bar, the cable 5 forms two parallel strands 5A and 5B between the end sleeve 7 and the slide 11.

The rear left cable 6 passes through the closing sleeve 8, then goes entirely through the bar from the inside and passes through a deflection pulley (not shown) with a diagonal axis provided in the closing sleeve 7. At the exit from that pulley, the cable forms a first strand 6A that passes around the other deflection pulley provided on the slide 11 and then forms a second strand 6B, the distal end of which is fixed to the end sleeve 7.

The pulley provided in the slide 11 is thus common to the rear cables 5 and 6.

The strip 12 is integral at its end 12B (opposite the end 12A integral with the slide 11) with the fixed central sleeve 9 through an additional cable or rope 20. That rope passes over a deflection pulley (not shown) with a diagonal axis and provided in a second slide 21 that is integral with the end of the cylinder 16 turned towards the end sleeve 8.

The additional rope 20 thus comprises:

- a first strand 20A connecting the end 12 B of the strip 12 and the pulley of the second slide 21;
- a second strand 20B connecting said pulley or fixed central sleeve 9.

The gas piston 15 is of a type known in itself and is adapted to apply, depending on the relative position of the piston rod 17 and the cylinder body 16, a return force on the strip 12. That is because the latter is connected, by the additional rope 20 with a fixed total length to a fixed point of the bar, that is to say the central sleeve 9.

Reference is now made to FIGS. 5A to 5D showing the bar 2 of the FIG. 4 in four stages or positions of the mobile elements placed inside the bar, when the latter is being used associated with a sail.

Figure 5A:
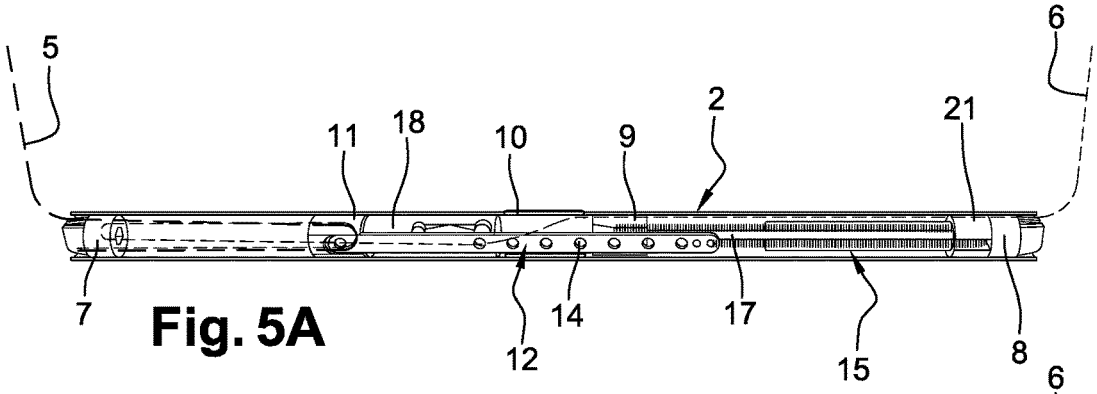
FIGS. 5A, 5B and 5C are front views of the bar in FIG. 4 with the means to extend/shorten the rear cables in different positions.

In FIG. 5A, the piston 17 is maximally extended. As a result, the second slide 21 is in its extreme position, that it so say resting against the end sleeve 8. That position corresponds to that in FIG. 3.

Figure 5B:
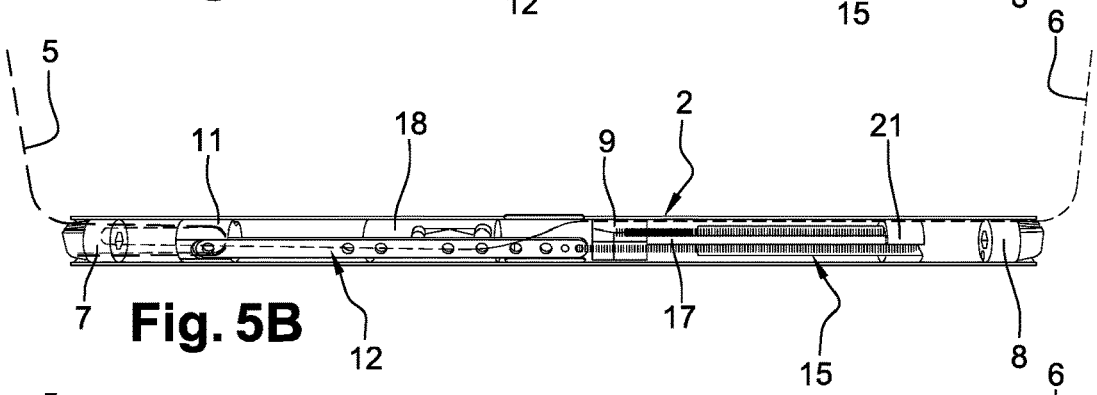

In FIG. 5B, as a result of the traction forces applied by the sail (not shown) and thus on the rear cables 5 and 6, the two slides 11 and 21 are displaced towards the left of the figure. The first slide 11 thus leads to the displacement of the strip 12 to the left. When that happens, the strands 5A, 5B, 6A and 6B are shortened since the distance between the end sleeve 7 and the slide 11 is reduced.

Figure 5C:
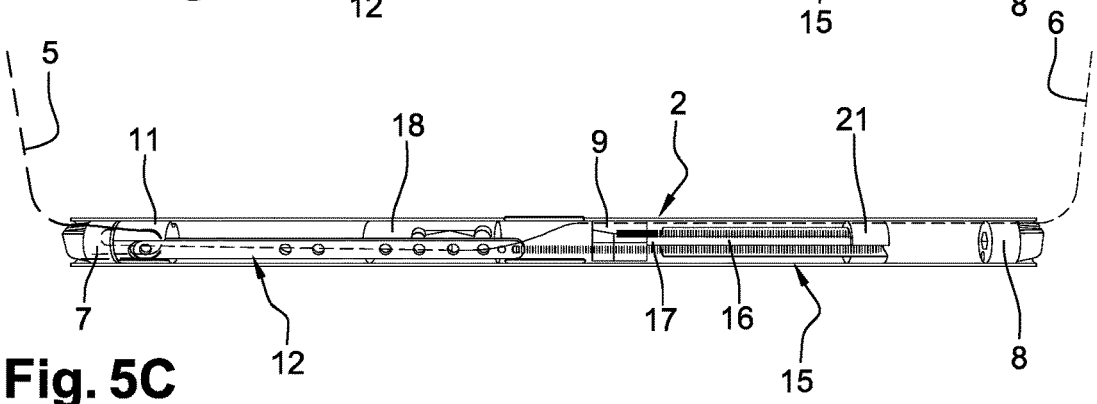

At the end of its range, the position shown in FIG. 5C is reached, where the slide 11 rests against the end sleeve 7 and the piston rod 17 is virtually totally retracted inside the cylinder body 16.

The displacement of mobile elements inside the bar extends/shortens the rear cables 5 and 6, so as to adjust the behavior of the sail, and its power, inclination etc.

Via the two deflection pulleys provided in the respective slides 11 and 21, it can be seen that a given extension/shortening distance "D" of the cables 5 and 6 leads to displacement "d" of the mobile elements of the bar that is such that d=D/4.

That makes it possible to limit the dimensions of the bar, while providing cable extension/shortening amplitude that is appreciable and sufficient for the user.

Figure 6A:
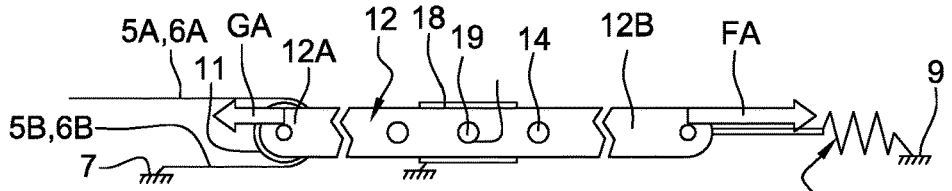
FIGS. 6A, 6B, and 6C are simplified schematic drawings of the operating principle of the means for extending/shortening the rear cables.
Figure 6B:
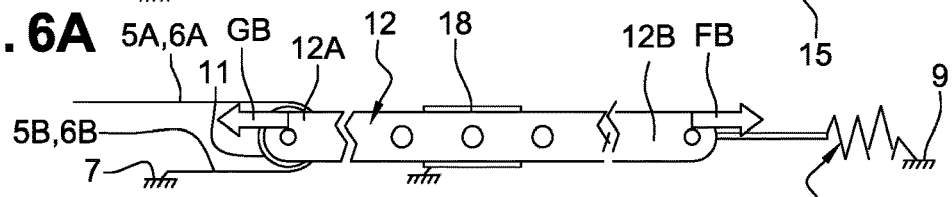
Figure 6C:
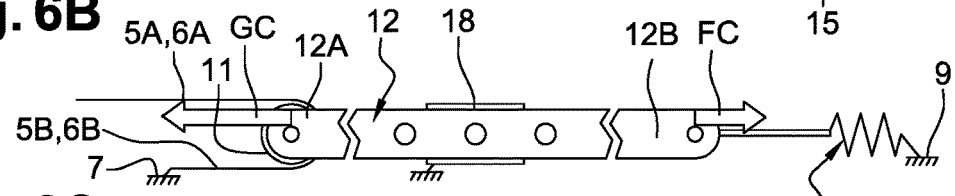

Reference is now made to FIGS. 6A to 6C, which schematically show the forces applied on the strip 12 and thus the cables 5 and 6. The additional rope 20/slide 21/gas piston 15 assembly is shown schematically by a spring, while the end sleeves 7 and 9 are symbolized by fixed fasteners.

In FIG. 6A, a position known as the idle position is shown, that is to say that the intensity of the force FA applied by the gas cylinder 15 on the strip 12 is greater than the force GA applied by the rear cables 5 and 6 on the strip 12. The forces FA and GA are in the direction of the longitudinal axis of the base, but are in opposite directions.

The lug 19 protrudes out and penetrates into the hole 13 of the strip 12, locking the displacement of the strip. The gas cylinder 15 thus applies a return force on the strip 12.

If the user presses the pushbutton (not shown and described later on) of the control mechanism 18, associated with the lug 19, that makes the lug go back once again into the bar 12, thus releasing the strip 12 which can thus be displaced again.

Because the intensity of the force FA is greater than the force GA, the strip thus moves to the right up to a balance position shown in FIG. 5B, where the strip is subjected to two forces FB (cylinder return) and GB (rear cables) of equal intensity in opposite directions.

That situation is that of a sail configuration known as "slightly hauled in".

The user may, if they wish, re-engage the lug 19 so that it blocks the strip 12 in that balance position.

If, on the contrary, the user's action is such that the lug 19 does not block the displacement of the strip 12, the forces applied by the rear cables become greater than the return force of the gas cylinder. The position shown in FIG. 5C is then reached, where the force GC applied on the strip by the rear cables is greater than the return force FC applied by the gas cylinder 15.

In FIG. 6B, the strip 12 is balanced, because it is subjected to two forces FB and GB of the same intensity and in opposite directions, along the longitudinal direction of the bar. The balance position is reached when the user "hauls in" the sail slightly, that is to say when moderate tension is applied on the bar by the sail.

Figure 7A:
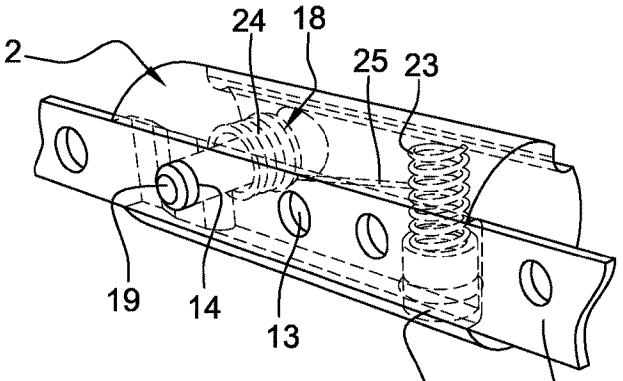
FIGS. 7A and 7B show an example of a mechanism for locking/releasing the strip in two positions.
Figure 7B:
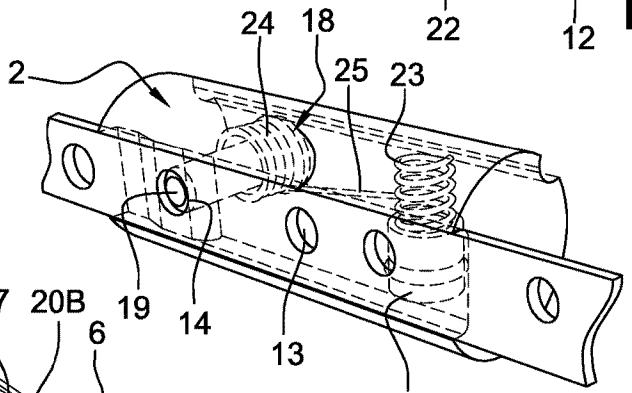

FIGS. 7A and 7B are perspective "exploded" views of part of the bar, showing the control mechanism 18 associated with the mobile lug 19 cooperating with the holes 13, 14 etc. of the strip 12, in order to lock or release its longitudinal displacement movement.

Said control mechanism 18 comprises:

- a pushbutton 22 that is accessible from the outside of the bar through an opening;
- a diagonal compression spring 23;
- a small hydraulic cylinder 24 connected to said locking lug 19 to move the lug between a first active position (FIG. 7A) where it penetrates into one of the holes of the strip and a second retracted position (FIG. 7B) where it allows the strip to slide freely;
- a rod 25 connected to the spring 23 and the cylinder 24 adapted to command the cylinder by controlling the spring.

The displacement axis of the locking lug 19 is substantially orthogonal, firstly with the displacement axis of the pushbutton 22 and secondly with the displacement plane of the strip. Thus, the user can control it with a thumb, from below the bar substantially facing the ground.

Figure 8:
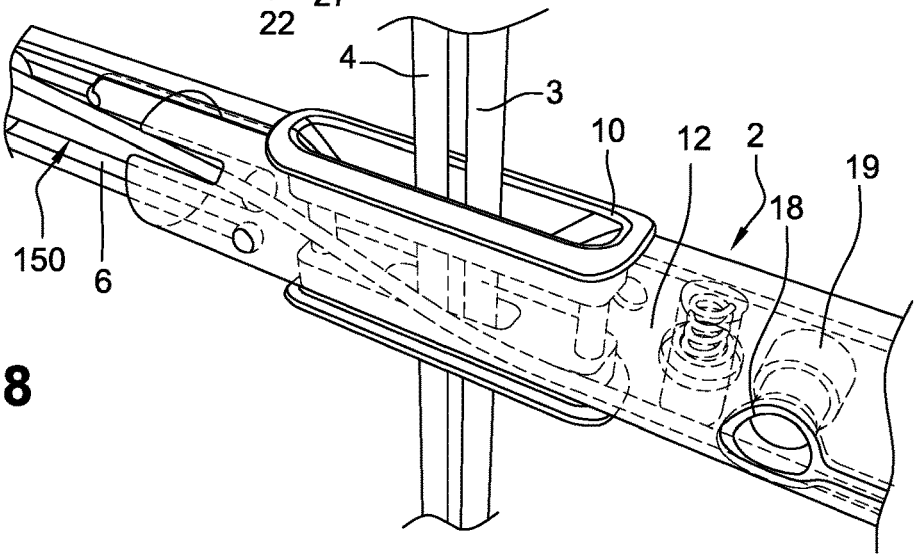
FIG. 8 is a detailed perspective view of the bar in FIGS. 3 and 4.

FIG. 8 is a perspective cutaway view of a part of the bar in FIG. 4 particularly showing part of the cylinder 15 and the deflection system, the through sleeve 10 for routing cables, and the means for locking/releasing the strip (FIGS. 7A and 7B).

Figure 9:
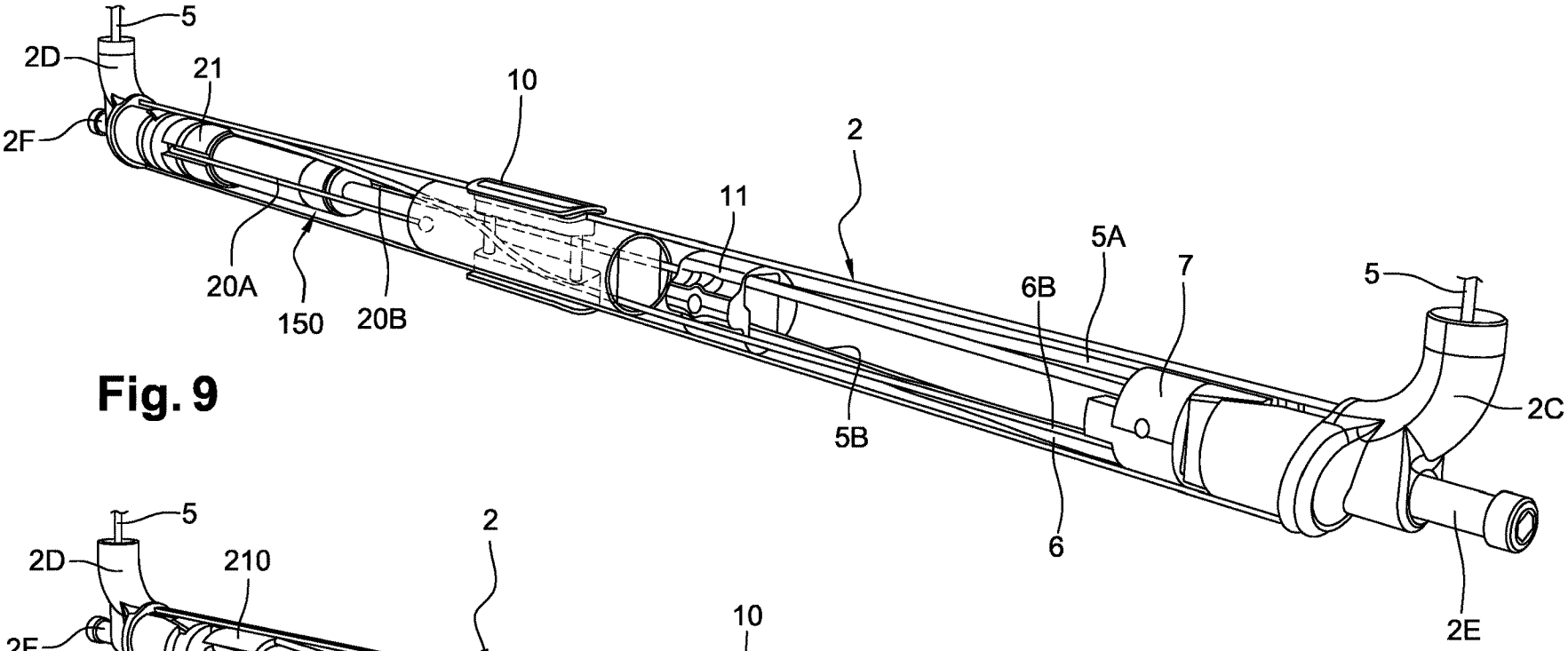
FIG. 9 is a perspective cutaway view of an alternative embodiment, with a cylinder known as a "self-locking" cylinder, with no strip.

FIG. 9 is a perspective cutaway view of the bar in another embodiment, with no strip, using a cylinder 150 known as a "self-locking" cylinder.

The self-locking cylinder is maneuvered by the user via a cam mechanism 26 described below, connected to a pushbutton 22 associated with a compression spring 23 (similar to those of the embodiment of FIGS. 7A and 7B).

Figure 10:
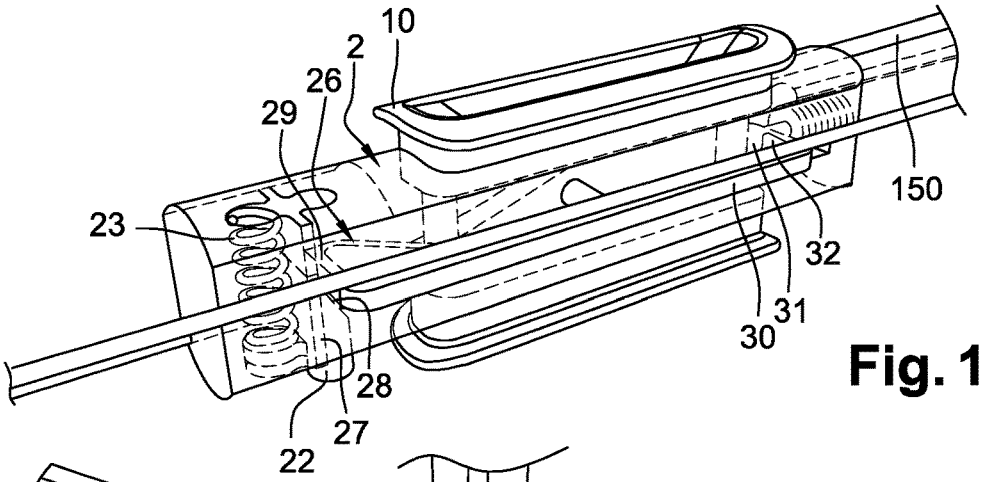
FIG. 10 is a perspective view of the cylinder locking/releasing means included in the embodiment of FIG. 9.

FIG. 10 is a detailed view of the locking system 26 associated with the self-locking cylinder 150.

The pushbutton 22 is integral with a rod 27 that can be displaced diagonally and provided with a bevel 28. A tab 29 is set against the bevel 28, wherein the tab itself is integral with a longitudinal arm 30 (passing before the sleeve 10) which is connected by a fork 31 to the piston 32 of the self-locking cylinder 150.

When the user presses the pushbutton 22, the rod 27 is displaced, which leads to longitudinal displacement when the bevel 28 pushes the diagonal tab 29. That leads to the displacement of the cylinder piston 32 via the arm 30 and the fork 31.

Figure 12A:
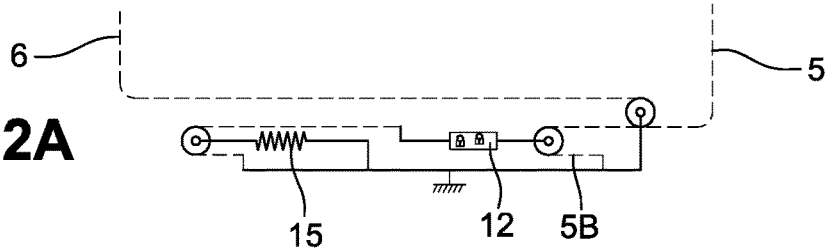
FIGS. 12A, 12B and 12C are simplified schematic drawings of the three forms of embodiment of the bar, of FIGS. 4, 9 and 11 respectively.
Figure 12B:
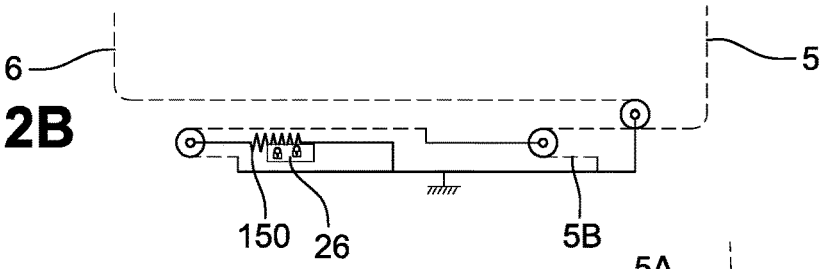

It is then subjected to the traction forces applied by cables 5 and 6, as shown schematically in FIG. 12B.

The self-locking cylinder 150 is of the type known to those skilled in the art, and is known as self-locking in that the displacement of its inner piston remains blocked until releasing action is applied to the piston by means of the pushbutton as described above.

When the user releases the pushbutton, the cylinder piston 32 is no longer subjected to the longitudinal displacement force (due to the movement explained above) and the piston is blocked once again.

Figure 11:
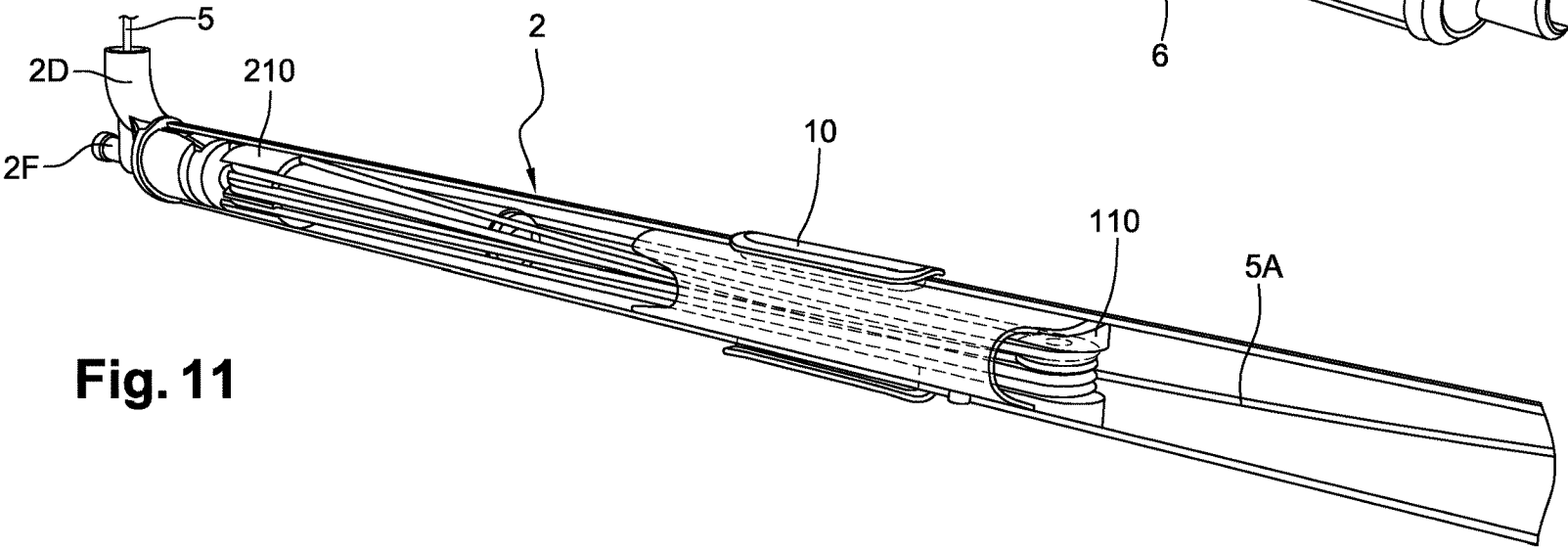
FIG. 11 is a perspective cutaway view of an alternative embodiment for FIG. 9, with a self-locking cylinder and pulleys with four deflections.

FIG. 11 is a perspective cutaway view of an alternative embodiment of FIG. 9, with a self-locking cylinder, and fitted with a system of pulleys with four deflections, 210 (near the fixed chamber of the cylinder 150) and 110 on the opposite side (beyond the sleeve 10) respectively.

Figure 12C:
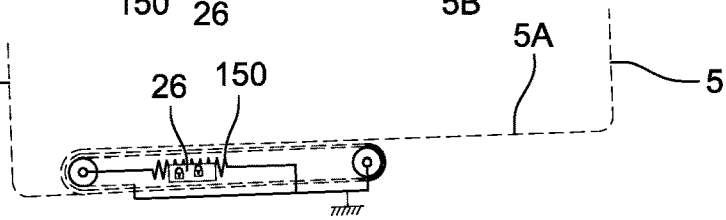

The configuration of FIG. 11 is shown schematically in FIG. 12C.

FIGS. 12A, 12B and 12C are schematic illustrations of the three forms of embodiment of the bar, and the means for extending/shortening the cables, of FIG. 4 (cylinder and strip), FIG. 9 (with no strip and with self-locking cylinder) and FIG. 11 (with no strip, with self-locking cylinder and pulleys with four transmissions) respectively.

The invention claimed is:

1. A command and control bar of a kite associated with two front cables and two rear cables, wherein the rear and front cables are configured to be connected at one end to the kite, the command and control bar has a substantially elongated cylindrical shape, the rear cables are connected to the command and control bar and the front cables are configured to be connected to a user; wherein the command and control bar comprises an adjustment element to shorten or extend the front or rear cables to vary an inclination or incidence of the kite, wherein the adjustment element to shorten or extend the rear cables are incorporated into the command and control bar so as to allow control with one hand of the user without releasing the command and control bar; wherein each rear cable is associated with a mobile deflection system that creates, for each rear cable, a cable strand of a variable length, the mobile deflection system is displaceable parallel to an axis of the command and control bar and connected to a return element; and wherein the command and control bar comprises a locking element configured to lock or release a position of the mobile deflection system along the command and control bar depending on traction forces applied on the rear cables, the locking element is accessible by at least one finger of the user from outside the command and control bar.

2. The command and control bar according to claim 1, wherein the return element comprises a gas lift cylinder or a return spring.

3. The command and control bar according to claim 1, further comprising a self-locking cylinder.

4. The command and control bar according to claim 1, further comprising a long element, one end of the long element is integral with the mobile deflection system and other end of the long element is connected to the return element.

5. The command and control bar according to claim 4, wherein the long element, the mobile deflection system, the cable strands of the variable length and the return element are arranged inside the command and control bar.

6. The command and control bar according to claim 4, wherein the locking element comprises a mobile male lug configured to be either in a locking position where the mobile male lug cooperates with openings or notches on the long element or in a retracted releasing position which allows the displacement of the long element.

7. The command and control bar according to claim 6, wherein the mobile male lug is connected by a transmission mechanism to a pushbutton controllable with a finger of the user from the outside of the command and control bar.

8. The command and control bar according to claim 4, wherein the long element is connected to the return element and to the deflection system by a respective pulley.

9. A device connected to a kite by at least one cable or line, the device configured to command and control said kite; wherein the device has a substantially elongated cylindrical shape and comprises an adjustment element to shorten or extend said at least one cable to stretch said kite or alter an inclination or incidence of said kite, wherein the adjustment element is incorporated into the device so as to allow control with one hand of a user without having to release the device; wherein said at least one cable is associated with a deflection system that creates a cable strand with a variable length, the deflection system is displaceable parallel to an axis of the device and is connected to a return element; and wherein the device comprises a locking element configure to lock or release a position of the deflection system along the device depending on traction forces applied on said at least one cable, the locking element is accessible by at least one finger of the user from outside the device.

10. An assembly of a kite, comprising at least one cable or line connecting the kite to a command and control bar according to claim 1.

11. An assembly of a kite, comprising at least one cable or line connecting the kite to the device according to claim 9.

12. The command and control bar according to claim 1, further comprising a strip, one end of the strip is integral with the mobile deflection system and other end of the strip is connected to the return element.

13. The command and control bar according to claim 12, wherein the strip, the mobile deflection system, the cable strands of the variable length and the return element are arranged inside the command and control bar.

14. The command and control bar according to claim 12, wherein the locking element comprises a mobile male lug configured to be either in a locking position where the mobile male lug cooperates with openings or notches on the strip or in a retracted releasing position which allows the displacement of the strip.

15. The command and control bar according to claim 14, wherein the mobile male lug is connected by a transmission mechanism to a pushbutton controllable with a finger of the user from the outside of the command and control bar.

16. The command and control bar according to claim 12, wherein the strip is connected to the return element and to the deflection system by a respective pulley.

* * * * *